US009575426B2

(12) United States Patent
Shimano et al.

(10) Patent No.: US 9,575,426 B2
(45) Date of Patent: Feb. 21, 2017

(54) TONER

(71) Applicant: CANON KABUSHIKI KAISHA, Tokyo (JP)

(72) Inventors: Tsutomu Shimano, Mishima (JP); Shintaro Noji, Mishima (JP); Hitoshi Itabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/318,222

(22) Filed: Jun. 27, 2014

(65) Prior Publication Data

US 2014/0308611 A1 Oct. 16, 2014

Related U.S. Application Data

(63) Continuation of application No. PCT/JP2013/084342, filed on Dec. 20, 2013.

(30) Foreign Application Priority Data

Dec. 28, 2012 (JP) ..... 2012-288236

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/0825* (2013.01); *G03G 9/08795* (2013.01); *G03G 9/08797* (2013.01); *G03G 9/09307* (2013.01); *G03G 9/09328* (2013.01); *G03G 9/09371* (2013.01); *G03G 9/09392* (2013.01)

(58) Field of Classification Search
CPC ..... G03G 9/08795; G03G 9/08797; G03G 9/08755; G03G 9/08711
See application file for complete search history.

(56) References Cited

U.S. PATENT DOCUMENTS

| | | | | |
|---|---|---|---|---|
| 2003/0129518 | A1* | 7/2003 | Sawada | G03G 9/0821 430/109.4 |
| 2004/0157147 | A1* | 8/2004 | Shiraishi et al. | 430/109.4 |
| 2005/0214670 | A1* | 9/2005 | Matsumoto et al. | 430/109.4 |
| 2006/0051686 | A1* | 3/2006 | Ide et al. | 430/18 |
| 2007/0166636 | A1* | 7/2007 | Daimon et al. | 430/109.3 |

(Continued)

FOREIGN PATENT DOCUMENTS

| | | |
|---|---|---|
| JP | 4879639 A | 10/1973 |
| JP | 59119362 A | 7/1984 |

(Continued)

*Primary Examiner* — Hoa V Le
(74) *Attorney, Agent, or Firm* — Canon U.S.A., Inc., IP Division

(57) ABSTRACT

It is an object of the present invention to provide a toner capable of being fixed at low energy and forming an image with high resistance to external forces, such as rubbing and scratching.
The object is achieved by a toner including toner particles that contain a binder resin and a colorant, a sea-island structure including a sea portion composed of the crystalline resin C serving as a main component and island portions composed of the amorphous resin A serving as a main component is observed at the observation of a cross section of each of the toner particles.

9 Claims, 1 Drawing Sheet

(56) References Cited

U.S. PATENT DOCUMENTS

| | | | | |
|---|---|---|---|---|
| 2009/0286176 | A1* | 11/2009 | Ohmura | G03G 9/08782 430/107.1 |
| 2011/0020743 | A1* | 1/2011 | Hirakata | C08F 287/00 430/108.4 |
| 2011/0065039 | A1* | 3/2011 | Ota | G03G 9/0821 430/109.3 |
| 2011/0305984 | A1* | 12/2011 | Tominaga et al. | 430/108.4 |
| 2012/0052434 | A1 | 3/2012 | Sugimoto | |
| 2012/0107741 | A1* | 5/2012 | Hiraoka | G03G 9/0806 430/137.12 |
| 2013/0323637 | A1* | 12/2013 | Watanabe | G03G 9/0802 430/109.4 |

FOREIGN PATENT DOCUMENTS

| | | | |
|---|---|---|---|
| JP | 6194874 | A | 7/1994 |
| JP | 7114207 | A | 5/1995 |
| JP | 2005266546 | A | 9/2005 |
| JP | 200684843 | A | 3/2006 |
| JP | 2008026887 | A | 2/2008 |
| JP | 2011180298 | A | 9/2011 |
| JP | 2012155121 | A | 8/2012 |

* cited by examiner

TONER

CROSS-REFERENCE TO RELATED APPLICATIONS

This application is a Continuation of International Patent Application No. PCT/JP2013/084342, filed Dec. 20, 2013, which claims the benefit of Japanese Patent Application No. 2012-288236, filed Dec. 28, 2012, both of which are hereby incorporated by reference herein in their entirety.

TECHNICAL FIELD

The present invention relates to a toner used to develop an electrostatic latent image formed by a method, for example, an electrophotographic method, an electrostatic recording method, or a toner jet recording method, to form a toner image.

BACKGROUND ART

In recent years, printers and copiers have been required to have lower power consumption and higher image quality, so toner has been required to have improved performance. In other words, a toner capable of being fixed at low energy and forming an image having high resistance to external forces, such as rubbing and scratching, has been required. However, there are trade-offs between these properties in typical resins.

To fix toner at low energy, toner is required to have the property of rapidly melting at relatively low temperature. To form images with high resistance to external forces, amorphous elastic resins are required rather than crystalline hard resins.

Thus, the combined use of a resin containing, as a main component, a moiety that has excellent sharp-melting properties and can have a crystalline structure (hereinafter, also referred to as a "crystalline resin") and an amorphous resin tends to be highly resistant to external forces has been studied. In particular, studies focused on phase-separated structures of crystalline resins and amorphous resins have been reported.

Japanese Patent Laid-Open Nos. 2011-180298 and 6-194874 report toners each having a sea-island structure (matrix-domain structure) in which island portions composed of a crystalline resin are formed in a sea portion composed of an amorphous resin. In this structure, however, the melting properties of each toner as a whole are governed by the amorphous resin constituting the sea portion, thus often failing to provide sufficient sharp-melting properties. When a fixing temperature is increased to the extent that the amorphous resin is melted, the melt viscosity of a binder resin as a whole is excessively reduced, so that a phenomenon in which an image sticks to a fixing device (offset phenomenon) tends to occur.

Japanese Patent Laid-Open No. 59-119362 reports a toner in which a phase-separated structure is controlled by the use of a hydrophilic-hydrophobic polymer compatible with a hydrophobic resin, the toner including a sea portion composed of a low-molecular-weight polyolefin and island portions composed of a hydrophobic polymer. In the foregoing configuration, the entire toner is instantaneously melted in a fixing step. Thus, the configuration has excellent sharp-melting properties. An image formed is mainly composed of a low-molecular-weight wax component and thus tends to have low resistance to external forces. Furthermore, problems with charging characteristics and the preservability of images at high humidity are liable to occur because of the use of the hydrophilic-hydrophobic polymer.

Japanese Patent Laid-Open Nos. 2005-266546 and 2006-84843 report toners each being composed of a crystalline resin as a main component and each having a structure in which a core composed of the crystalline resin is covered with a shell composed of an amorphous resin. In the foregoing configuration, it is possible to obtain the toners that make use of the sharp-melting properties of the crystalline resin. However, an image formed is liable to be damaged from rubbing and scratching because of the crystalline resin serving as a main component. Furthermore, in this configuration, it is difficult to adjust the viscosity of the toners. Thus, it is difficult to achieve both low-temperature fixability and high-temperature offset resistance.

As described above, various phase-separated structures composed of crystalline resins and amorphous resins are devised in toners into which crystalline resins are incorporated. However, a toner capable of being fixed at low energy and providing an image with high resistance to external forces, such as rubbing and scratching, is not yet reported.

The present invention provides a toner in which the conventional problems described above have been solved.

It is an object of the present invention to provide a toner capable of being fixed at low energy and forming an image with high resistance to external forces, such as rubbing and scratching.

SUMMARY OF INVENTION

The present invention relates to a toner including toner particles containing a binder resin and a colorant, in which the binder resin contains an amorphous resin A and a crystalline resin C, the crystalline resin C has a melting point Tm (C) of 50° C. or higher and 110° C. or lower, and in a cross section observation of each of the toner particles, a sea-island structure including a sea portion composed of the crystalline resin C serving as a main component and island portions composed of the amorphous resin A serving as a main component, is observed.

Further features of the present invention will become apparent from the following description of exemplary embodiments with reference to the attached drawings.

DESCRIPTION OF EMBODIMENTS

The inventors have conducted intensive studies on a phase-separated structure of resins from the viewpoint of enabling fixation at low energy and forming an image with high resistance to external forces and have found that a sea-island structure of the present invention is effective. This finding has led to the completion of the present invention.

The observation of a cross section of a toner particle in a toner of the present invention reveals that the toner has a sea portion composed of a crystalline resin serving as a main component.

To utilize the crystalline resin for the toner without impairing the sharp-melting properties of the crystalline resin, it is not enough for a binder resin just to be composed of the crystalline resin serving as a main component. That is, the crystalline resin must have the dominant effect on the melting properties of the toner. To this end, it is believed that the crystalline resin needs to be present so as not to be separated by an amorphous resin and that the crystalline resin needs to form a sea portion of the sea-island structure. For example, in the case where a phase-separated structure in which the crystalline resin forms island portions surrounded by a sea portion composed of an amorphous resin, the melting properties of the toner are governed by the amorphous resin. In some cases, the sharp-melting properties were obtained to some extent by controlling the compatibility between the amorphous resin and the crystalline resin that forms the island portions. However, it was difficult to sufficiently exhibit the sharp-melting properties of the crystalline resin itself.

In the toner of the present invention, island portions composed of an amorphous resin serving as a main component are present in the sea portion composed of the crystalline resin serving as a main component. The presence of the islands composed of the amorphous resin serving as a main component results in the formation of a permanent image composed of a resin mixture of the crystalline resin and the amorphous resin. The resin mixture suppresses the crystallization of the crystalline resin in a cooling step after fixation to reduce the brittleness of the crystalline resin, thereby resulting in the image with excellent strength. Furthermore, the use of the amorphous resin facilitates the control of the toner as a whole.

Figure 1:
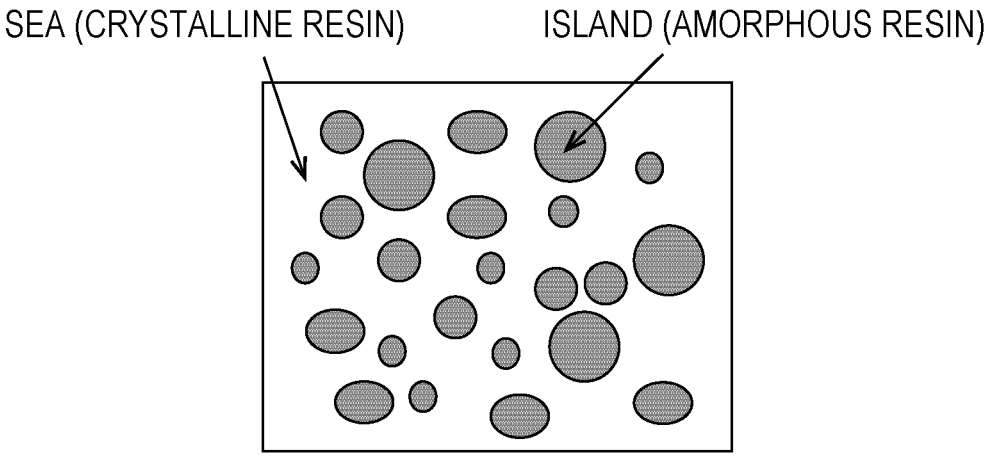
FIG. 1 is a schematic drawing of an example of a sea-island structure of the present invention.
Figure 2:
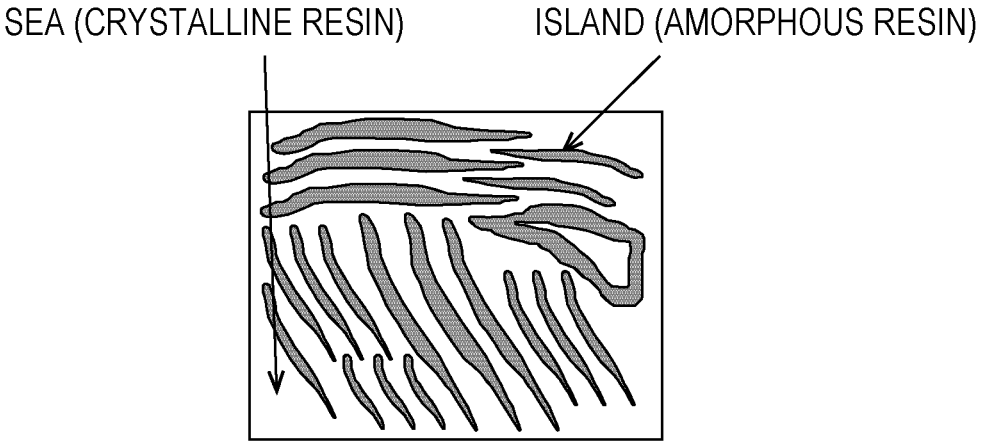
FIG. 2 is a schematic drawing of an example of a sea-island structure of the present invention.

In the present invention, the sea-island structure is also what is called a matrix-domain structure that includes a sea portion serving as a continuous phase and a discontinuous phase corresponding to island portions. For example, a structure in which circular island portions are dispersively present (see FIG. 1) may be used. Alternatively, a structure in which elongated island portions are present side by side (see FIG. 2) may be used. Part of the sea portion may be present as a discontinuous phase. On the whole, a structure including the sea portion present as a continuous phase and the island portions present as a discontinuous phase may be used. A method for observing the sea-island structure will be described in detail below.

To form the foregoing sea-island structure, a known toner production method, for example, a pulverization method, a dissolution-suspension method, a suspension polymerization method, or an emulsification-aggregation method, may be employed. The production methods have different ways of controlling phase separation.

In the pulverization method, the dissolution-suspension method, and the suspension polymerization method, the control of the phase-separated structure is conducted from a state in which a crystalline resin and an amorphous resin are each dissolved, by the use of the mass ratio and a difference in physical property on the basis of compositions of the materials. In the emulsification-aggregation method, a crystalline resin and an amorphous resin are each formed into emulsion particles and then aggregated to form a toner. It is thus necessary to control the order and ratio of the materials aggregated and the dispersion stability of the emulsion particles. Among these, the use of the suspension polymerization method enables easy control of the size of each island of the sea-island structure, the dispersion state of the islands, and the phase-separated state of the sea and the islands and thus is preferred.

The crystalline resin and the amorphous resin will be described below.

In the present invention, the crystalline resin C has a melting point Tm (C) of 50° C. or higher and 110° C. or lower. The melting point of the crystalline resin C serving as a main component is within the foregoing range, thus providing satisfactory low-temperature fixability of a toner. The crystalline resin C preferably has a melting point Tm (C) of 60° C. or higher and 85° C. or lower.

The crystalline resin C preferably has a weight-average molecular weight Mw (C) of 5,000 or more and 100,000 or less from the viewpoint of achieving both the low-temperature fixability and the strength of an image. An Mw (C) of 5,000 or more results in the formation of a more definite sea-island structure, thereby providing a toner having better sharp-melting properties and having excellent heat-resistant preservability and durability. An Mw (C) of 100,000 or less results in better sharp-melting properties of a toner and allows mixing with the amorphous resin to proceed satisfactorily at the time of fixing, thereby forming an image having sufficient resistance to rubbing and scratching. The Mw (C) is more preferably 5,000 or more and 80,000 or less. The Mw (C) can be easily controlled by conditions, such as the temperature and the time of the polymerization and polycondensation of the crystalline resin C and the amounts of a polymerization initiator and a catalyst. A method for measuring the Mw (C) will be described below.

The amorphous resin A preferably has a weight-average molecular weight Mw (A) of 8,000 or more and 50,000 or less. An Mw (A) of 8,000 or more results in the formation of a more definite sea-island structure, thus sufficiently exhibiting the sharp-melting properties of the crystalline resin. An Mw (A) of 50,000 or less allows mixing with the crystalline resin to proceed satisfactorily at the time of fixing, thereby forming an image having sufficient resistance to rubbing and scratching. The Mw (A) is more preferably 10,000 or more and 40,000 or less. The Mw (A) can be easily controlled by conditions, such as the temperature and the time of the polymerization and polycondensation of the amorphous resin A and the amounts of a polymerization initiator and a catalyst. A method for measuring the Mw (A) will be described below.

In the present invention, the absolute value of a difference between an SP value "SP(C)" of the crystalline resin C and an SP value "SP (A)" of the amorphous resin A, i.e., ΔSP (CA), is preferably 0.3 or more and 1.5 or less. At a ΔSP (CA) of 0.3 or more, the crystalline resin and the amorphous resin are not significantly influenced by each other, and a more definite sea-island structure can be formed. This results in a toner having excellent sharp-melting properties and heat-resistant preservability. At a ΔSP (CA) of 1.5 or less, when the crystalline resin and the amorphous resin are phase-separated in a cooling step, the amorphous resin is not transferred to a surface of a toner, and a structure in which the island portions composed of the amorphous resin are present in the sea portion composed of the crystalline resin is easily formed. The compatibilization of the crystalline resin and the amorphous resin occurs easily in a fixing step, thus providing an image with excellent strength.

The SP value of each of the resins may be controlled by constituent monomers and physical properties, such as molecular weight. The SP value may be calculated by Fedors's method. Specifically, details are described in, for example, Polymer engineering and science, vol. 14, pages 147 to 154. The SP value may be calculated from the following expression:

$$SP\ \text{value}=\sqrt{(Ev/v)}=\sqrt{(\Sigma\Delta ei/\Sigma\Delta vi)} \quad \text{expression:}$$

(where in the expression, Ev represents the energy of vaporization (cal/mol), v represents the molar volume ($cm^3$/mol), Δei represents the energy of vaporization of each atom or atomic group, and Δvi represents the molar volume of each atom or atomic group).

In the present invention, the binder resin preferably has a crystalline resin C content of 30% by mass or more and 70% by mass or less. A content of 30% by mass or more facilitates the control of the sea-island structure and results in a toner having excellent sharp-melting properties. A content of 70% by mass or less results in the clear formation of islands composed of the amorphous resin, thereby providing an image with excellent strength. The crystalline resin C content may be controlled by the amount of the crystalline resin or a monomer constituting the crystalline resin. A method for measuring the crystalline resin C content will be described below.

In the present invention, the composition of the crystalline resin C is not particularly limited. A known crystalline resin may be used. Specific examples thereof include crystalline polyester and crystalline acrylic resins. In the present invention, the crystalline resin refers to a resin that exhibits a clear endothermic peak in the curve of a reversible change in specific heat obtained by measurement of a change in specific heat with a differential scanning calorimeter described below.

The crystalline resin C is preferably a side-chain crystalline resin. In the case of the side-chain crystalline resin, a reduction in crystallinity due to the effect of the folding of a molecular chain seems to be less likely to occur, thus providing better sharp-melting properties. The side-chain crystalline resin refers to a resin in which aliphatic and/or aromatic side chains are attached to a skeleton (main chain) of an organic structure, the resin having a structure that can form a crystalline structure between the side chains. Examples of the side-chain crystalline resin include α-olefin-based resins, alkyl acrylate-based resins, alkyl methacrylate-based resins, alkyl ethylene oxide-based resins, siloxane-based resins, and acrylamide-based resins.

In the present invention, the crystalline resin C is preferably a vinyl-based resin containing a moiety represented by the general formula 1 (a unit derived from a long-chain alkyl acrylate or long-chain alkyl methacrylate) in an amount of 50% by mass or more.

general formula 1

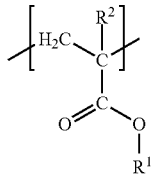

where $R^1$ represents an alkyl group having 16 to 34 carbon atoms, and $R^2$ represents hydrogen or a methyl group.

In the vinyl-based resin containing, as a main component, a unit derived from a long-chain alkyl acrylate or long-chain alkyl methacrylate represented by the general formula 1, the main chain does not inhibit the crystallinity of the side chains, thus providing a resin having high crystallinity. Furthermore, the resulting crystalline resin has excellent strength. In the case where the number of carbon atoms in $R^1$ is within the foregoing range, a polymerization reaction proceeds sufficiently, thus providing a crystalline resin with a high conversion ratio, the crystalline resin having excellent durability and charging performance after exposure to a high-temperature, high-humidity environment. Specific examples of the long-chain alkyl acrylate include palmityl acrylate, stearyl acrylate, behenyl acrylate, octacosanyl acrylate, triacontyl acrylate, and tetratriacontyl acrylate. Specific examples of the long-chain alkyl methacrylate include palmityl methacrylate, stearyl methacrylate, behenyl methacrylate, octacosanyl methacrylate, triacontyl methacrylate, and tetratriacontyl methacrylate.

In the present invention, each of the toner particles preferably has a core-shell structure and has the effect of inhibiting a high-temperature offset phenomenon at the time of fixing. The core-shell structure in the present invention refers to a structure of a core covered with a shell, the core containing the crystalline resin and the amorphous resin that form the sea-island structure. The core containing the crystalline resin and the amorphous resin is covered with the shell, so that the crystalline resin and the amorphous resin are uniformly mixed in each of the toner particles at the time of fixing. A resin constituting the shell preferably has a storage modulus G' of $1\times10^4$ Pa to $1\times10^{10}$ Pa at the melting point Tm of the crystalline resin. In this case, the shell portion maintains satisfactory elasticity at the time of the melting of the crystalline resin, so that the foregoing effect is more satisfactorily provided. As a result, an image having better fixing strength is formed in a wider fixing temperature range. Furthermore, the penetration of the crystalline resin can be inhibited, thus forming an image having better gloss. A method for measuring the storage modulus of the resin constituting the shell and a method for identifying the state of the presence will be described below.

An example of a method for forming a shell is, but not particularly limited to, a method in which after the formation of toner particles, a resin constituting the shell is allowed to adhere to surfaces of the toner particles by an aqueous process or a dry process (hereinafter, also referred to as a "surface adhesion method"). In addition, in the case of a suspension polymerization method or a dissolution-suspension method, a method (what is called an in situ method) in which by suspending a highly polar resin in a dissolved state, the resin is localized to the surfaces of the toner particles is preferably employed.

In the case where a resin S constituting the shell has an acid value AV (S) of 10.0 mgKOH/g or more and 40.0 mgKOH/g or less, upon letting the acid value of the crystalline resin C be AV (C) (mgKOH/g), $$5.0\ \text{mgKOH/g} \leq AV(S) - AV(C)$$

is preferably satisfied.

In the case where the relationship is satisfied, the toner of the present invention has excellent charging characteristics and, in particular, environmental characteristics. Although the details are unclear, it is believed that the foregoing configuration provides charging characteristics that are less affected by temperature and humidity by virtue of a balance between a higher acid value of the shell resin mainly responsible for a charging phenomenon and the acid value of the crystalline resin that uniformizes the resulting charge.

In the case of the suspension polymerization method or the dissolution-suspension method, when AV (S) is within the foregoing range, it is possible to form a shell with excellent production stability and excellent coverage. A difference between AV (S) and AV (C) of 5.0 mgKOH/g or more results in the minimization of the effect of the resin constituting the shell on the sea-island structure in the core and is thus preferred.

In the present invention, upon letting the acid value of the amorphous resin A be AV (A), a difference between AV (A) and AV (C) (AV (C)−AV (A)) is preferably 0 mgKOH/g or more and 10.0 mgKOH/g or less. In this range, it is possible to form a more preferred sea-island structure.

AV (S), AV (C), and AV (A) may be controlled by, for example, the types, proportions, and molecular weights of monomers constituting the resins. A method for measuring AV (S), AV (C), and AV (A) will be described below.

Materials that may be used as binder resins for toners may be used as materials for the resin S constituting the shell and the amorphous resin A. For example, styrene-acrylic-based resins, polyester resins, epoxy resins, and urethane resins may be used. Among these, in view of controlling the acid values and the SP values to form the sea-island structure, styrene-acrylic-based resins and polyester resins are preferred. These resins may be used in combination. These resins may be hybridized. These resins may be partially modified.

As a styrene-acrylic-based resin used in the present invention, a product prepared by the polymerization of a known radically polymerizable monomer may be used. Specific examples of the radically polymerizable monomer are described below.

Examples thereof include styrene and derivatives thereof, such as styrene and o-methylstyrene; ethylenically unsaturated monoolefins, such as ethylene and propylene; vinyl halides, such as vinyl chloride and vinyl bromide; vinyl esters, such as vinyl acetate; acrylic esters, such as n-butyl acrylate and 2-ethylhexyl acrylate; methacrylic esters in which "acrylic" of the acrylic esters is replaced with "methacrylic"; amino methacrylates, such as dimethylaminoethyl methacrylate and diethylaminoethyl methacrylate; vinyl ethers, such as methyl vinyl ether and ethyl vinyl ether; vinyl ketones, such as methyl vinyl ketone; N-vinyl compounds, such as N-vinylpyrrole; vinylnaphthalenes; acrylic acid and methacrylic acid derivatives, such as acrylonitrile and methacrylamide; and acrylic acid and methacrylic acid. The radically polymerizable monomers may be used in combination of two or more, as needed.

To improve the high-temperature offset resistance, a small amount of a polyfunctional monomer (crosslinking agent) may be used for the styrene-acrylic-based resin. As the polyfunctional monomer, a compound having two or more polymerizable double bonds is mainly used. Examples thereof include aromatic divinyl compounds, such as divinylbenzene and divinylnaphthalene; carboxylic esters each having two double bonds, such as ethylene glycol diacrylate; divinyl compounds, such as divinylaniline, divinyl ether, divinyl sulfide, and divinyl sulfone; and compounds each having three or more vinyl groups.

The polyester resin in the present invention may be prepared by the reaction of a di- or poly-carboxylic acid and a diol. In the case where the polyester resin is a crystalline polyester, a crystalline polyester mainly composed of an aliphatic diol and an aliphatic dicarboxylic acid is preferred because of a high degree of crystallinity.

As an alcohol monomer used to prepare the polyester resin, a known alcohol monomer may be used. Specific examples of the alcohol monomer that may be used include alcohol monomers, such as ethylene glycol, diethylene glycol, and 1,2-propylene glycol; dihydric alcohols, such as polyoxyethylenated bisphenol A; aromatic alcohols, such as 1,3,5-trihydroxymethylbenzene; and trihydric alcohols, such as pentaerythritol.

As a carboxylic acid monomer used to prepare the polyester resin, a known carboxylic acid monomer may be used. Specific examples of the carboxylic acid monomer that may be used include dicarboxylic acids, such as oxalic acid and sebacic acid, and anhydrides and lower alkyl esters of these acids; and 3- or poly-carboxylic acid components, such as trimellitic acid, 2,5,7-naphthalenetricarboxylic acid, 1,2,4-naphthalenetricarboxylic acid, pyromellitic acid, 1,2,4-butanetricarboxylic acid, 1,2,5-hexanetricarboxylic acid, and 1,3-dicarboxyl-2-methyl-2-methylenecarboxypropane, and their derivatives, such as anhydrides and lower alkyl esters thereof.

The polyester resin that may be used in the present invention may be produced by a known method for the synthesis of polyester. For example, a dicarboxylic acid component and a dialcohol component are subjected to an esterification reaction or a transesterification reaction, followed by a polycondensation reaction under reduced pressure or introduction of nitrogen gas in the usual manner to provide the polyester resin.

In the esterification reaction or the transesterification reaction, a common esterification catalyst or transesterification catalyst, for example, sulfuric acid, titanium butoxide, dibutyltin oxide, manganese acetate, or tetrabutyl titanate, may be used, as needed. Regarding the polymerization, a common polymerization catalyst, for example, titanium butoxide, dibutyltin oxide, tin acetate, zinc acetate, tin disulfide, antimony trioxide, and germanium dioxide, may be used. The polymerization temperature and the amount of the catalyst are not particularly limited and may be freely selected, as needed.

Acid values of an amorphous polyester and a crystalline polyester may also be controlled by end-capping a carboxyl group at a polymer end.

A monocarboxylic acid or a monoalcohol may be used for end-capping. Examples of the monocarboxylic acid include monocarboxylic acids, such as acrylic acid, benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid. As the monoalcohol, methanol, ethanol, propanol, isopropanol, butanol, or a higher alcohol may be used.

The amorphous resin A preferably has a glass transition temperature Tg (A) of 40° C. or higher and 80° C. or lower. In this range, it is possible to provide sufficient heat-resistant preservability and excellent low-temperature fixability of a toner. Furthermore, Tm (C) and Tg (A) satisfy the relationship:

$$0^\circ\ \mathrm{C.} \leq Tm(C) - Tg(A) \leq 30^\circ\ \mathrm{C.}$$

In the case where the relationship is satisfied, the timing of the melting of the crystalline resin C is close to that of the amorphous resin A at the time of fixing. This results in the strong entanglement of the resins, thereby providing an image with excellent strength.

Tm (C) and Tg (A) may be controlled by the types and proportions of monomers constituting the crystalline resin C and the amorphous resin A, the molecular weights of the resins, and so forth. A Method for measuring Tm (C) and Tg (A) will be described below.

In the sea-island structure observed in the cross-sectional observation of the toner, the number-average circle-equivalent diameter based on the area of the island portions is preferably 30 nm or more and 500 nm or less. At a number-average circle-equivalent diameter of 30 nm or more, the crystalline resin C is less affected by the amorphous resin A, thus providing a toner having sufficient sharp-melting properties. At a number-average circle-equivalent diameter of 500 nm or less, the crystalline resin C and the amorphous resin A are sufficiently mixed together in a fixation step, thus providing an image with excellent strength. The average distance in the short-axis direction of the island portions may be controlled by the molecular weights, the SP values, and the acid values of the crystalline resin C and the amorphous resin A, the cooling rate in the production of the toner particles, and so forth. A method for measuring the number-average circle-equivalent diameter of the island portions will be described below.

The toner of the present invention contains a colorant. As the colorant, known colorants, for example, a variety of conventionally known dyes and pigments, may be used.

As black colorants, carbon black, magnetic materials, and colorants subjected to tone adjustment to black by the use of yellow, magenta, and cyan colorants are used. As colorants for a cyan toner, a magenta toner, and a yellow toner, for example, colorants described below may be used.

As yellow pigment colorants, compounds, such as monoazo compounds, disazo compounds, condensation azo compounds, isoindolinone compounds, anthraquinone compounds, azo metal complex methine compounds, and allylamide compounds, are used. Specific examples thereof include C.I. Pigment Yellows 74, 93, 95, 109, 111, 128, 155, 174, 180, and 185.

As magenta colorants, monoazo compounds, condensation azo compounds, diketopyrrolopyrrole compounds, anthraquinone, quinacridone compounds, basic dye lake compounds, naphthol compounds, benzimidazolone compounds, thioindigo compounds, and perylene compounds are used. Specific examples thereof include C.I. Pigment Reds 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269; and C.I. Pigment Violet 19.

As cyan colorants, copper phthalocyanine compounds and derivatives thereof, anthraquinone compounds, and basic dye lake compounds may be used. Specific examples thereof include C.I. Pigment Blues 1, 7, 15, 15:1, 15:2, 15:3, 15:4, 60, 62, and 66.

In the case where the toner of the present invention is used as a magnetic toner, the toner particles may contain a magnetic material. In this case, the magnetic material may also serve as a colorant. In the present invention, examples of the magnetic material include iron oxides, such as magnetite, hematite, and ferrite; metals, such as iron, cobalt, and nickel; and alloys of these metals and metals, for example, aluminum, cobalt, copper, lead, magnesium, tin, zinc, antimony, beryllium, bismuth, cadmium, calcium, manganese, selenium, titanium, tungsten, and vanadium, and mixtures thereof.

A release agent that may be used in the present invention is not particularly limited, and known release agents may be used. Examples of a compound serving as the release agent include low-molecular-weight polyethylene; low-molecular-weight polypropylene; aliphatic hydrocarbon wax, such as microcrystalline wax, paraffin wax, and Fischer-Tropsch wax; oxides of aliphatic hydrocarbon wax, such as oxidized polyethylene wax, and block copolymers thereof; wax mainly containing fatty esters, such as carnauba wax, Sasol wax, ester wax, and montanic acid ester wax; compounds, such as deoxidized carnauba wax, prepared by partially or entirely deoxidizing fatty esters; wax prepared by grafting vinyl monomers, such as styrene and acrylic acid, to aliphatic hydrocarbon wax; partially esterified compounds of fatty acids and polyhydric alcohols, such as behenic acid monoglyceride; and hydroxyl group-containing methyl ester compounds prepared by, for example, hydrogenation of vegetable fat and oil.

In the toner particles of the present invention, a charge control agent may be used. In particular, a charge control agent that allows the toner particles to be negatively chargeable is preferably used. Examples of the charge control agent are described below.

Examples thereof include organometallic compounds, chelate compounds, monoazo metal compounds, metal acetylacetonate compounds, urea derivatives, metal-containing salicylic acid-based compounds, metal-containing naphthoic acid-based compounds, quaternary ammonium salts, calixarenes, silicon compounds, and non-metallic carboxylic acid-based compounds and derivatives thereof. Furthermore, sulfonic acid type resins containing sulfo groups, sulfonate groups, and sulfonic acid esters are preferably used.

The toner particles of the present invention are preferably produced by a suspension polymerization method. The toner particles produced by the suspension polymerization method have high circularity and excellent flowability, thereby providing a toner which is less likely to cause image defects over a prolonged period of time and which has excellent durability.

The production of the toner by the suspension polymerization method is performed as described below.

To begin with, a colorant and other necessary components (for example, a release agent, a crosslinking agent, a charge control agent, a chain transfer agent, a plasticizer, a pigment dispersant, and a release agent dispersant) are dissolved or dispersed in polymerizable monomers to prepare a polymerizable monomer composition. At this time, a dispersing machine, for example, a homogenizer, a ball mill, a colloid mill, or an ultrasonic dispersing machine may be used. To produce the toner of the present invention, the polymerizable monomers which form a crystalline resin by polymerization and which form an amorphous resin by polymerization may be used. Regarding one or part of the crystalline resin and the amorphous resin, a resin that has been prepared by polymerization in advance may be dissolved in the corresponding polymerizable monomer. Subsequently, the polymerizable monomer composition is added to a dispersion stabilizer-containing aqueous medium prepared in advance and suspended with a high-speed dispersing machine, for example, a high-speed agitator or an ultrasonic dispersing machine. The polymerization initiator may be mixed together with other additives upon preparing the polymerizable monomer composition or may be added to the polymerizable monomer composition immediately before the polymerizable monomer composition is suspended in the aqueous medium. Alternatively, the polymerization initiator may be added in a dissolved state in the polymerizable monomer or another solvent, as needed, during granulation or after the completion of the granulation, i.e., immediately before the initiation of the polymerization reaction. Then the polymerization reaction is performed by heating the resulting suspension under stirring in such a manner that the droplet particles of the polymerizable monomer composition in the suspension maintain the particle state and floating or settling of the particles does not occur, thereby forming toner particles. Thereafter, the suspension is cooled, if necessary, washed. Drying and classification are performed by a variety of methods, thereby providing toner particles.

An example of a method for forming the toner having the sea-island structure that includes the sea portion composed of the crystalline resin as a main component and the island portions composed of the amorphous resin specified in the present invention is a method in which the amorphous resin is precipitated in the droplet particles with the crystalline resin being in a molten state. It is believed that in this method, the islands composed of the amorphous resin are formed in the sea composed of the crystalline resin because the precipitated amorphous resin is easily moved.

In the suspension polymerization method, a specific method for precipitating the amorphous resin with the crystalline resin being in the molten state will be described below and is not limited to the method described below.

First, the crystalline resin and the amorphous resin are compatibilized with each other at the time of the completion of the polymerization reaction. When the resulting toner is cooled from the compatibilized state, one of the resins is precipitated because the compatibility of the crystalline resin and the amorphous resin is reduced. At this time, when the cooling rate is sufficiently low, it is possible to precipitate the amorphous resin with the crystalline resin being in the molten state.

In this case, the temperature of the suspended particles at the time of the completion of the polymerization reaction is preferably a temperature equal to or higher than the melting point Tm (C) of the crystalline resin and a temperature equal to or higher than the glass transition temperature Tg (A) of the amorphous resin. In the case where the polymerization temperature is lower than Tm (C) or Tg (A), a rise in temperature may be conducted after the completion of the polymerization.

The crystalline resin and the amorphous resin may be compatibilized by the addition of a solvent. In the case where the solvent is added, solvent removal treatment is needed. It is believed that in the solvent removal treatment, a resin having lower solubility in the solvent is first precipitated. In the present invention, thus, a solvent in which the crystalline resin is highly soluble is preferably selected. Specifically, upon letting the solubility parameter (SP) value of the solvent be SP (L), letting the SP value of the crystalline resin be SP(C), and letting the SP value of the amorphous resin be SP (A), $$|SP(L)-SP(C)|\leq|SP(L)-SP(A)|$$

holds preferably.

As the dispersion stabilizer added to the aqueous medium, known surfactants, organic dispersants, and inorganic dispersants may be used. Among these, inorganic dispersants are preferred because an ultrafine powder is less likely to be formed, the stability is not easily reduced even if the polymerization temperature is changed, and washing is easily performed. Examples of inorganic dispersants include polyvalent metal salts of phosphoric acid, for example, tricalcium phosphate, magnesium phosphate, aluminum phosphate, and zinc phosphate; carbonates, e.g., calcium carbonate and magnesium carbonate, and inorganic salts, e.g., calcium metasilicate, calcium sulfate, and barium sulfate; and inorganic oxides, e.g., calcium hydroxide, magnesium hydroxide, aluminum hydroxide, silica, bentonite, and alumina. After the completion of the polymerization, these inorganic dispersants can be almost completely removed by dissolving them with the addition of an acid or alkali.

As the polymerization initiator, a variety of peroxide-based polymerization initiators and azo-based polymerization initiators may be used. Examples of organic peroxide-based polymerization initiators that may be used include peroxyesters, peroxydicarbonates, dialkyl peroxides, peroxy ketals, ketone peroxides, hydroperoxides, and diacyl peroxides. Examples of inorganic peroxide-based polymerization initiators include persulfates and hydrogen peroxide. Specific examples thereof include peroxyesters, such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropylmonocarbonate, and t-butyl peroxy-2-ethylhexylmonocarbonate; diacyl peroxides, such as benzoyl peroxide; peroxydicarbonates, such as diisopropyl peroxydicarbonate; peroxy ketals, such as 1,1-di-t-hexyl peroxycyclohexane; dialkyl peroxides, such as di-t-butyl peroxide; and other compounds, such as t-butyl peroxyallylmonocarbonate. Examples of azo based polymerization initiators that may be used include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl-2,2'-azobis(2-methylpropionate). If necessary, two or more polymerization initiators may be simultaneously used.

In the toner of the present invention, preferably, a flowability improving agent is externally added in order to improve image quality. Examples of the flowability improving agent that is preferably used include inorganic fine powders composed of silica, titanium oxide, and aluminum oxide. These inorganic fine powders are preferably subjected to hydrophobization treatment with a hydrophobizing agent, for example, a silane coupling agent, a silicone oil, or a mixture thereof. Furthermore, in the toner of the present invention, an external additive other than the flowability improving agent may be mixed with the toner particles, as needed.

The toner of the present invention may be used as a one-component developer as-is or as a two-component developer after being mixed with a magnetic carrier.

Methods for measuring physical properties specified in the present invention will be described below.

Separation of Crystalline Resin C and Amorphous Resin A in Toner

In the case where the crystalline resin C and the amorphous resin A are required to be separated from the toner in order to measure the physical properties of the crystalline resin C and the amorphous resin A in the toner, the separation is performed as described below.

To separate the crystalline resin C and the amorphous resin A from the toner, methyl ethyl ketone is used. A resin component soluble in methyl ethyl ketone is regarded as the amorphous resin A. A resin component insoluble in methyl ethyl ketone is regarded as the crystalline resin C. In the case of a toner having a shell, resin particles that do not have a shell are produced. A component of the resin particles soluble in methyl ethyl ketone is regarded as the amorphous resin. An extraction method with methyl ethyl ketone is not particularly limited. For example, a method as described below may be employed.

First, 1.0 g of a toner is dispersed and dissolved in 50.0 ml of methyl ethyl ketone in an environment of 25° C. The resulting solution is then separated into a supernatant and a sediment by centrifugation with a high-speed cooling centrifuge H-9R (rotor model used: IN, capacity: 100 ml×6, manufactured by Kokusan Co., Ltd.) at 15,000 rpm for 60 minutes in an environment of 25° C. The sediment is taken out and washed with 100.0 ml of methyl ethyl ketone. A resin component in the resulting component is regarded as the crystalline resin C. The supernatant is charged into an evaporator. The pressure is reduced to 5000 Pa to evaporate methyl ethyl ketone. The residue is regarded as the amorphous resin A.

Method for Observing Sea-Island Structure of Toner and Shell, and Method for Measuring Number-Average Circle-Equivalent Diameter of Island Portion in Sea-Island Structure A method for observing the crystalline resin in the toner particles is as follows: After the toner particles are sufficiently dispersed in a photocurable epoxy resin, the epoxy resin is cured by irradiation with ultraviolet radiation. The resulting cured product is cut with a microtome equipped with a diamond knife to produce a thin-section sample. The sample is stained with ruthenium tetroxide. Then the cross sections of the toner particles are observed and photographed with a transmission electron microscope (TEM) (H7500, manufactured by HITACHI Ltd.) at an accelerating voltage of 120 kV. Amorphous portions are strongly stained with ruthenium tetroxide. Thus, the island portions composed of the amorphous resin A serving as a main component and the shell portions are strongly stained. The sea portions composed of the crystalline resin C serving as a main component are weakly stained. This enables the observation of the sea-island structure and the shells. Note that the observation was performed at ×20,000 magnification.

An image obtained by the foregoing photographing was read at 600 dpi through an interface and introduced into an image analyzer WinROOF Version 5.6 (manufactured by Microsoft-Mitani Corporation). Contrast and brightness were appropriately adjusted in such a manner that the island portions composed of the amorphous resin A observed on the cross section of the toner were clearly seen. Then binarization, hole filling, and noise removal were performed. The areas of the island portions were measured. Circle-equivalent diameters, which are diameters of circles having the same areas as the measured areas, were calculated on the basis of the measured areas. The measurement was performed until the number of data sets measured reached 100 counts. The number average thereof was determined and defined as the circle-equivalent diameter of the island portions.

Method for Measuring Weight-Average Molecular Weight of Crystalline Resin C and Amorphous Resin A The molecular-weight distribution of each of the crystalline resin C and the amorphous resin A is measured by gel permeation chromatography (GPC) as described below.

The crystalline resin C or the amorphous resin A is dissolved in chloroform at room temperature over a period of 24 hours. The resulting solution is filtered with a solvent-resistant membrane filter "MAISHORIDISK" (manufactured by Tosoh Corporation) having a pore size of 0.5 μm to give a sample solution. The sample solution is adjusted in such a manner that the concentration of a component soluble in chloroform is 0.5% by mass. Measurement is performed with the sample solution under conditions described below.

Instrument: HLC 8220 GPC (detector: RI, UV) (manufactured by Tosoh Corporation)

Columns: TSKgel G4000HXL, TSKgel G3000HXL, TSKgel G2000HXL (manufactured by Tosoh Corporation)

Eluent: chloroform

Flow rate: 1.0 ml/min

Oven temperature: 45.0° C.

Amount of sample injected: 0.10 ml

To calculate the molecular weight of the sample, a molecular weight calibration curve is used, molecular weight calibration curve being formed by the use of standard polystyrene resins (for example, trade name "TSK Standard Polystyrene F-850, F-450, F-288, F-128, F-80, F-40, F-20, F-10, F-4, F-2, F-1, A-5000, A-2500, A-1000, and A-500", manufactured by Tosoh Corporation).

Acid Value of Crystalline Resin C, Amorphous Resin A, and Resin S Constituting Shell The acid values of the resins are measured according to JIS K1557-1970. A specific measurement method will be described below. First, 2 g of a pulverized sample is accurately weighed (W (g)). The sample is charged into a 200-ml Erlenmeyer flask. Then 100 ml of a toluene/ethanol (2:1) solvent mixture is added thereto, and dissolution is performed for 5 hours. A phenolphthalein solution is added as an indicator. The foregoing solution is titrated with a burette using a 0.1 mol/L KOH solution in alcohol. At this time, let S (ml) denote the amount of the KOH solution. A blank test is performed. At this time, let B (ml) denote the amount of the KOH solution.

The acid value is calculated from the following expression. In the expression, "f" represents a factor of the KOH solution.

$$\text{Acid value (mgKOH/g)}=[(S-B)\times f\times 5.61]/W$$

Melting Point Tm (C) of Crystalline Resin C, Glass Transition Temperature Tg (A) of Amorphous Resin A, and Crystalline Resin Content The melting point of Tm (C) of the crystalline resin C, the glass transition temperature Tg (A) of the amorphous resin A, and the crystalline resin content are measured with a differential scanning calorimeter "Q1000" (manufactured by TA Instruments) according to ASTM D3418-82.

The melting points of indium and zinc are used for the temperature correction of the detection portion of the calorimeter. The heat of fusion of indium is used for the correction of the amount of heat.

Specifically, the measurement is performed as described below. First, 2 mg of a measurement sample is accurately weighed and placed into an aluminum pan. An empty aluminum pan is used as a reference. A modulation measurement is performed in a measurement range of 0° C. to 120° C. at a preset rate of temperature increase of 1° C./min and a preset modulation temperature amplitude of ±0.318° C./min. In the heating process, a change in specific heat is obtained in the temperature range of 0° C. to 120° C. The peak value of the endothermic curve of the crystalline resin C is defined as the melting point of Tm (C) (° C.). The glass transition temperature Tg (A) (° C.) of the amorphous resin A is defined as the point of intersection of a line intermediate between baselines before and after the appearance of the curve of a reversible change in specific heat and the differential thermal curve.

In the present invention, the crystalline resin content Cw (% by mass) may be determined from the following expression on the basis of the amount of heat absorbed calculated from the endothermic curve measured under the foregoing conditions, $$Cw\ (\%\ \text{by mass})=100\times Q2/Q1$$

where Q1 represents the amount of heat absorbed (J/g) per gram of the crystalline resin alone, and Q2 represents the amount of heat absorbed (J/g) per gram of the toner particles at an endothermic peak originating from the crystalline resin.

In the case where endothermic peaks of the crystalline resin and the release agent are overlapped with each other, assuming that 100% of the release agent is crystallized in the toner particles, the crystalline resin content may be determined from the foregoing calculation by subtraction of the amount of heat absorbed by the release agent.

Storage Modulus of Resin Constituting Shell

Regarding a measurement apparatus, a rotational flat plate-type rheometer "ARES" (manufactured by TA INSTRUMENTS) is used.

Regarding a measurement sample, a sample produced by molding a toner under pressure into a disk shape having a diameter of 8.0 mm and a thickness of 2.0±0.3 mm using a tablet machine in an environment with a temperature of 25° C. is used.

The sample is attached to parallel plates. The temperature is increased from room temperature (25° C.) to 120° C. over a period of 5 minutes to adjust the shape of the sample. Subsequently, the temperature is reduced to 30° C., which is a temperature at which the viscoelasticity measurement is started. Then the measurement is started.

The measurement is performed under conditions described below.

(1) Parallel plates 8.0 mm in diameter are used.
(2) The frequency is 1.0 Hz.
(3) The initial applied strain is set to 0.1%.
(4) The measurement is performed at a rate of temperature increase (Ramp Rate) of 2.0° C./min between 30° C. to 150° C. The measurement is performed under conditions set in an automatic adjustment mode described below. The measurement is performed in an automatic strain adjustment (Auto Strain) mode.
(5) The maximum strain (Max Applied Strain) is set to 20.0%.
(6) The maximum torque (Max Allowed Torque) is set to 200.0 g·cm. The minimum torque (Min Allowed Torque) is set to 2.0 g·cm.
(7) The strain adjustment (Strain Adjustment) is set to 20.0% of Current Strain. In the measurement, an automatic tension adjustment mode (Auto Tension) is used.
(8) The automatic tension direction (Auto Tension Direction) is set to "Compression".
(9) The initial static force (Initial Static Force) is set to 10.0 g. The automatic tension sensitivity (Auto Tension Sensitivity) is set to 40.0 g.
(10) The operational condition of the automatic tension (Auto Tension) is as follows: a sample modulus (Sample Modulus) of $1.0\times10^5$ (Pa) or more.

Measurement of Nuclear Magnetic Resonance ($^1$H-NMR) of Crystalline Resin C

The measurement was performed under conditions as described below.

Measurement apparatus: FT NMR system JNM-EX400 (manufactured by JEOL Ltd.)
Measuring frequency: 400 MHz
Pulse condition: 5.0 μs
Data point: 32768
Frequency range: 10,500 Hz
Number of scans: 10,000
Measurement temperature: 60° C.
Sample: A sample is prepared by charging 50 mg of a measurement sample into a sample tube having a diameter of 5 mm, adding $CDCl_3$ serving as a solvent thereto, and dissolving the sample in the solvent in a temperature-controlled oven set at 60° C.

EXAMPLES

While the present invention is specifically described below by examples, the present invention is not limited to these examples. "Parts" used in the examples all indicate parts by mass.

Synthesis Example 1

Production of Crystalline Resin 1

The following materials were charged into a reaction vessel equipped with a reflux condenser, a stirrer, a thermometer, and a nitrogen introducing tube in a nitrogen atmosphere.

| | |
|---|---|
| toluene | 100.0 parts |
| behenyl acrylate | 100.0 parts |
| 2,2'-azobis(2,4-dimethylvaleronitrile) (V-65, manufactured by Wako Pure Chemical Industries, Ltd.) | 10.0 parts |

The mixture in the vessel was stirred at 200 rpm, heated to 60° C., and stirred for 12 hours. The mixture was then heated to 95° C. and stirred for 8 hours. Removal of the solvent provides crystalline resin 1. Crystalline resin 1 had a weight-average molecular weight of 22,000, an acid value of 0.2 mgKOH/g, and a melting point of 65° C.

Synthesis Examples 2 to 5

Production of Crystalline Resins 2 to 5

Crystalline resins 2 to 5 were produced by the same reaction as in Synthesis Example 1, except that the composition was changed as described in Table 1.

TABLE 1

| | Monomer composition | Solvent | Polymerization initiator | Polymerization temperature |
|---|---|---|---|---|
| Crystalline resin 1 | behenyl acrylate 100.0 parts | toluene 100.0 parts | V65 10.0 parts | 60° C. |
| Crystalline resin 2 | behenyl acrylate 100.0 parts | toluene 150.0 parts | V65 10.0 parts | 75° C. |
| Crystalline resin 3 | behenyl acrylate 100.0 parts | toluene 200.0 parts | V65 10.0 parts | 75° C. |
| Crystalline resin 4 | behenyl acrylate 100.0 parts | toluene 100.0 parts | V65 5.0 parts | 75° C. |
| Crystalline resin 5 | behenyl acrylate 100.0 parts acrylic acid 3.0 parts | toluene 100.0 parts | V65 5.0 parts | 75° C. |

Synthesis Example 6

Production of Crystalline Resin 6

Into a reaction vessel equipped with a stirrer, a thermometer, and a condenser for extraction, 100.0 parts of sebacic acid, 100.0 parts of 1,12-dodecanediol, and 0.2 parts of tetrabutyl titanate were charged. The mixture was allowed to react at 160° C. for 5 hours. Then the mixture was heated to 200° C. while the pressure in the system was gradually reduced. The mixture was allowed to react under reduced pressure for 5 hours to give crystalline resin 6.

Synthesis Example 7

Production of Crystalline Resin 7

Crystalline resin 7 was produced by the same reaction as in Synthesis Example 6, except that the composition was changed to a composition containing 100.0 parts sebacic acid, 80.0 parts 1,9-nonanediol, and 0.2 parts tetrabutyl titanate.

Synthesis Example 8

Production of Crystalline Resin 8

Crystalline resin 8 was produced by the same reaction as in Synthesis Example 6, except that the composition was changed to a composition containing 90.0 parts dodecanedicarboxylic acid, 50.0 parts diethylene glycol, and 0.2 parts tetrabutyl titanate.

Synthesis Example 9

Production of Crystalline Resin 9

Crystalline resin 9 was produced by the same reaction as in Synthesis Example 6, except that the composition was changed to a composition containing 80.0 parts dodecanedicarboxylic acid, 60.0 parts diethylene glycol, and 0.2 parts tetrabutyl titanate.

Table 2 describes the physical properties of crystalline resins 1 to 9.

TABLE 2

| | Mw(C) | SP(C) | AV(C) (mgKOH/g) | Tm(C) (° C.) |
|---|---|---|---|---|
| Crystalline resin 1 | 22000 | 8.9 | 0.2 | 65 |
| Crystalline resin 2 | 6600 | 8.9 | 0.0 | 61 |
| Crystalline resin 3 | 4500 | 8.9 | 0.1 | 58 |
| Crystalline resin 4 | 13000 | 8.9 | 0.0 | 65 |
| Crystalline resin 5 | 13200 | 9.0 | 17.7 | 66 |
| Crystalline resin 6 | 11000 | 9.5 | 2.5 | 81 |
| Crystalline resin 7 | 7000 | 9.7 | 6.2 | 70 |
| Crystalline resin 8 | 10000 | 9.9 | 5.0 | 105 |
| Crystalline resin 9 | 10000 | 9.9 | 3.8 | 110 |

Synthesis Example 10

Production of Amorphous Resin 1

The following materials were charged into a reaction vessel equipped with a reflux condenser, a stirrer, a thermometer, and a nitrogen introducing tube in a nitrogen atmosphere.

| | |
|---|---|
| styrene | 100.0 parts |
| n-butyl acrylate | 25.0 parts |
| toluene | 50.0 parts |
| t-butyl peroxypivalate | 10.0 parts |

The mixture in the vessel was stirred at 200 rpm, heated to 70° C., and stirred for 10 hours. The mixture was then heated to 95° C. and stirred for 8 hours. Removal of the solvent provides amorphous resin 1. Amorphous resin 1 had a weight-average molecular weight of 10,000, an acid value of 0.4 mgKOH/g, and a glass transition temperature of 60° C.

Synthesis Examples 11 and 12

Production of Amorphous Resin 2 and 3

Amorphous resins 2 and 3 were produced by the same reaction as in Synthesis Example 10, except that the amount of the monomer fed and the polymerization temperature were changed as described in Table 3.

TABLE 3

| | Monomer composition | Solvent | Polymerization initiator | Polymerization temperature |
|---|---|---|---|---|
| Amorphous resin 1 | styrene 100.0 parts<br>n-butyl acrylate 25.0 parts | toluene 50.0 parts | 10.0 parts | 70° C. |
| Amorphous resin 2 | styrene 100.0 parts<br>n-butyl acrylate 20.0 parts | toluene 100.0 parts | 10.0 parts | 85° C. |
| Amorphous resin 3 | styrene 50.0 parts<br>n-butyl acrylate 20.0 parts<br>methyl methacrylate 100.0 parts<br>methacrylic acid 8.0 parts | toluene 100.0 parts | 10.0 parts | 85° C. |

Synthesis Example 13

Production of Amorphous Resin 4

The following materials were charged into a reaction vessel equipped with a condenser, a stirrer, and a nitrogen introducing tube. The mixture was allowed to react under normal pressure at 200° C. for 10 hours, cooled to 170° C., and reduced in pressure to 1 mmHg over a period of 1 hour. The mixture was allowed to react for another 5 hours to give amorphous resin 4.

| | |
|---|---|
| Two-mole propylene oxide adduct of bisphenol A (BPA-PO) | 40.0 parts |
| ethylene glycol | 15.0 parts |
| terephthalic acid | 25.0 parts |
| isophthalic acid | 10.0 parts |
| tetrabutyl titanate | 0.1 parts |

Synthesis Examples 14 and 15

Production of Amorphous Resins 5 and 6

Amorphous resins 5 and 6 were produced by the same reaction as in Synthesis Example 13, except that the amount of the monomer fed and the reaction time under normal pressure were changed as described in Table 4.

TABLE 4

| | Alcohol monomer (parts by mass) Two-mole | | Acid monomer (parts by mass) | | Reaction time under normal pressure (hours) |
|---|---|---|---|---|---|
| | PO adduct of BPA | Ethylene glycol | Terephthalic acid | Isophthalic acid | |
| Amorphous resin 4 | 40.0 | 15.0 | 25.0 | 10.0 | 10.0 |
| Amorphous resin 5 | 45.0 | 10.0 | 20.0 | 20.0 | 15.0 |
| Amorphous resin 6 | 40.0 | 20.0 | 40.0 | 22.0 | 10.0 |

Table 5 describes the physical properties of amorphous resins 1 to 6.

TABLE 5

| | Type of resin | Mw (A) | SP (A) | AV (A) (mgKOH/g) | Tg (A) (° C.) |
|---|---|---|---|---|---|
| Amorphous resin 1 | styrene acrylic | 10000 | 9.8 | 0.4 | 60 |
| Amorphous resin 2 | styrene acrylic | 7600 | 9.8 | 0.2 | 60 |
| Amorphous resin 3 | styrene acrylic | 5800 | 10.1 | 29.0 | 55 |
| Amorphous resin 4 | polyester | 11000 | 10.3 | 1.2 | 59 |
| Amorphous resin 5 | polyester | 18000 | 10.2 | 1.5 | 68 |
| Amorphous resin 6 | polyester | 9600 | 10.5 | 10.8 | 63 |

Synthesis Example 16

Production of Resin S1 for Shell

The following materials were charged into a reaction vessel equipped with a reflux condenser, a stirrer, a thermometer, and a nitrogen introducing tube in a nitrogen atmosphere.

| | |
|---|---|
| styrene | 80.0 parts |
| n-butyl acrylate | 20.0 parts |
| methyl methacrylate | 3.0 parts |
| methacrylic acid | 1.5 parts |
| toluene | 100.0 parts |
| t-butyl peroxypivalate | 10.0 parts |

The mixture in the vessel was stirred at 200 rpm, heated to 80° C., and stirred for 10 hours. The mixture was then heated to 95° C. and stirred for 8 hours. Removal of the solvent provides resin S1 for a shell. Resin S1 for a shell had a weight-average molecular weight of 10,000, an acid value of 12.0 mgKOH/g, and a glass transition temperature of 70° C. Furthermore, the storage modulus of resin S1 for a shell was measured according to the foregoing method.

Synthesis Example 17

Production of Resin S2 for Shell

The following materials were charged into a reaction vessel equipped with a reflux condenser, a stirrer, a thermometer, and a nitrogen introducing tube in a nitrogen atmosphere.

| | |
|---|---|
| styrene | 80.0 parts |
| n-butyl acrylate | 20.0 parts |
| methyl methacrylate | 3.0 parts |
| methacrylic acid | 0.7 parts |
| toluene | 100.0 parts |
| t-butyl peroxypivalate | 10.0 parts |

The mixture in the vessel was stirred at 200 rpm, heated to 80° C., and stirred for 10 hours. The mixture was then heated to 95° C. and stirred for 8 hours. Removal of the solvent provides resin S2 for a shell. Resin S2 for a shell had a weight-average molecular weight of 11,000, an acid value of 4.2 mgKOH/g, and a glass transition temperature of 70° C.

Synthesis Example 18

Production of Dispersion S3 of Fine Resin Particles for Shell

Into a reaction vessel equipped with a stirrer, a condenser, a thermometer, and a nitrogen introducing tube, 350.0 parts of ion-exchanged water and 0.5 parts of sodium dodecylbenzenesulfonate were fed. The mixture was heated to 90° C. in a nitrogen atmosphere. Then 8 parts of 2% aqueous hydrogen peroxide and 8 parts of a 2% aqueous solution of ascorbic acid were added thereto. Subsequently, the following monomer mixture, an aqueous emulsifier solution, and an aqueous solution of a polymerization initiator were added dropwise over a period of 5 hours under stirring.

| | |
|---|---|
| styrene | 80.0 parts |
| n-butyl acrylate | 20.0 parts |
| methyl methacrylate | 3.0 parts |
| methacrylic acid | 3.2 parts |
| sodium dodecylbenzenesulfonate | 0.3 parts |
| polyoxyethylene nonylphenyl ether | 0.1 parts |
| ion-exchanged water | 20.0 parts |
| 2% aqueous hydrogen peroxide | 40.0 parts |
| 2% aqueous solution of ascorbic acid | 40.0 parts |

After the dropwise addition, the polymerization reaction was performed for another 2 hours with the foregoing temperature maintained. The mixture was cooled. The resin concentration in the resulting dispersion was adjusted to 20% by the addition of ion-exchanged water, thereby providing dispersion S3 of fine resin particles for a shell. Part of the dispersion was dried. The physical properties of the resulting resin were measured and found that the resin had a weight-average molecular weight of 21,000, an acid value of 19.0 mgKOH/g, and a glass transition temperature of 70° C.

Production Example 1 of Toner Slurry

The following materials were dispersed with an attritor (manufactured by Mitsui Miike Chemical Engineering Machinery, Co., Ltd.) to give a polymerizable monomer composition.

| | |
|---|---|
| crystalline resin 1 | 84.0 parts |
| styrene | 100.0 parts |
| n-butyl acrylate | 25.0 parts |
| resin S1for shell | 10.0 parts |
| pigment blue 15:3 (manufactured by Dainichiseika Color & Chemicals Mfg. Co., Ltd.) | 6.0 parts |
| aluminum salicylate compound (Bontron E-88, manufactured by Orient Chemical Industries Co., Ltd.) | 1.0 part |
| release agent: paraffin wax (HNP-51, manufactured by Nippon Seiro Co., Ltd., melting point: 74° C.) | 9.0 parts |
| toluene (SP value: 8.8) | 100.0 parts |

To a container equipped with a high-speed agitator TK-homomixer (manufactured by Tokushu Kika Kogyo Co. Ltd.), 800 parts of ion-exchanged water and 15.5 parts of tricalcium phosphate were added. The number of revolutions was adjusted to 15,000 rpm. The mixture was heated to 70° C. to provide a dispersion system.

The polymerizable monomer composition was heated to 60° C. After confirmation of crystalline resin 1, 6.0 parts of t-butyl peroxypivalate serving as a polymerization initiator was added thereto. The mixture was added to the foregoing dispersion system. A granulation step was performed for 20 minutes with the high-speed agitator while 12,000 rpm was maintained. Thereafter, the agitator was changed from the high-speed agitator to a propeller-type impeller. The polymerization was performed for 10.0 hours under stirring at 150 rpm with the dispersion temperature in the container maintained at 70° C. After the completion of the polymerization, the dispersion temperature was increased to 95° C. to remove the unreacted polymerizable monomer and toluene by evaporation.

After the completion of the polymerization, the resulting dispersion of polymer particles was cooled to 20° C. at an average cooling rate of 0.6° C./min under stirring. The concentration of the polymer particles in the dispersion was adjusted to 20% by mass by the addition of ion-exchanged water to give toner slurry 1.

Production Examples 2, 5, 6, 8, 10 to 12, 15 to 17, 21 to 24, and 28 of Toner Slurry Toner slurries 2, 5, 6, 8, 10 to 12, 15 to 17, 21 to 24, and 28 were produced as in Production Example 1 of the toner slurry, except that the composition and the polymerization temperature were changed as described in Table 6.

Production Examples 3, 7, 9, 13, 14, 19, 20, and 26 of Toner Slurry

Core-particle slurries were produced as in Production Example 1 of the toner slurry, except that the composition and the polymerization temperature were changed as described in Table 6.

To 500.0 parts of each of the resulting core-particle slurries (solid content: 100.0 parts), 25.0 parts of dispersion S3 of fine resin particles for a shell (solid content: 5.0 parts), which was produced in Synthesis Example 18, was slowly added under stirring. The temperature of a heating oil bath was increased. Stirring was continued for 2 hours with the temperature maintained at 70° C. to perform treatment for allowing the shell resin to adhere to surfaces of particles contained in the core-particle slurry, thereby providing toner slurries 3, 7, 9, 13, 14, 19, 20, and 26.

Production Example 4 of Toner Slurry

Production of Crystalline Resin Dispersion

First, 100.0 parts of crystalline resin 6, 90.0 parts of toluene, and 2.0 parts of diethylaminoethanol were fed into a reaction vessel equipped with a stirrer, a condenser, a thermometer, and a nitrogen introducing tube and dissolved by heating to 80° C. Then phase inversion emulsification was performed by slow addition of 300.0 parts of ion-exchanged water with a temperature of 80° C. under stirring. Subsequently, the resulting aqueous dispersion was transferred to a distillation apparatus. Distillation was performed until the fraction temperature reached 100° C. After cooling, the resin concentration in the resulting aqueous dispersion was adjusted to 20% by the addition of ion-exchanged water to give a crystalline resin dispersion.

Production of Amorphous Resin Dispersion

First, 100.0 parts of crystalline resin 4, 90.0 parts of toluene, and 2.0 parts of diethylaminoethanol were fed into a reaction vessel equipped with a stirrer, a condenser, a thermometer, and a nitrogen introducing tube and dissolved by heating to 80° C. Then phase inversion emulsification was performed by slow addition of 300.0 parts of ion-exchanged water with a temperature of 80° C. under stirring. Subsequently, the resulting aqueous dispersion was transferred to a distillation apparatus. Distillation was performed until the fraction temperature reached 100° C. After cooling, the resin concentration in the resulting aqueous dispersion was adjusted to 20% by the addition of ion-exchanged water to give an amorphous resin dispersion.

Production of Colorant Dispersion

| | |
|---|---|
| pigment blue 15:3 manufactured by Dainichiseika Color & Chemicals Mfg. Co., Ltd.) | 70.0 parts |
| anionic surfactant (trade name: Neogen SC, manufactured by Dai-ichi Kogyo Seiyaku Co., Ltd.) | 3.0 parts |
| ion-exchanged water | 400.0 parts |

The foregoing components were mixed together and dissolved. The mixture was subjected to dispersion with a homogenizer (Ultra Turrax, manufactured by IKA) to give a colorant dispersion.

Production of Release Agent Dispersion

| | |
|---|---|
| paraffin wax (HNP-51, manufactured by Nippon Seiro Co., Ltd., melting point: 74° C.) | 100.0 parts |
| anionic surfactant (trade name: Pionin A-45-D, manufactured by Takemoto Oil & Fat Co., Ltd.) | 2.0 parts |
| ion-exchanged water | 500.0 parts |

The foregoing components were mixed together and dissolved. The mixture was subjected to dispersion with a homogenizer (Ultra Turrax, manufactured by IKA). Dispersion treatment was performed with a pressure discharge-type Gaulin homogenizer to give a release agent dispersion in which fine particles of the release agent (paraffin wax) were dispersed

| | |
|---|---|
| crystalline resin dispersion stated above | 120.0 parts |
| amorphous resin dispersion stated above | 120.0 parts |
| colorant dispersion stated above | 50.0 parts |
| release agent dispersion stated above | 60.0 parts |

-continued

| | |
|---|---|
| cationic surfactant (trade name: Sanisol B50, manufactured by Kao Corporation) | 3.0 parts |
| ion-exchanged water | 500.0 parts |

The foregoing components were mixed together and dispersed in a round-bottom stainless steel flask with a homogenizer (trade name: Ultra-Turrax T50, manufactured by IKA) to prepare a liquid mixture. The liquid mixture was then heated to 50° C. with a heating oil bath and held at 50° C. for 30 minutes to form aggregated particles. Next, 60.0 parts of the crystalline resin dispersion and 6.0 parts of an anionic surfactant (trade name: Neogen SC, manufactured by Dai-ichi Kogyo Seiyaku Co., Ltd.) were added to the dispersion in which the aggregated particles were dispersed. The mixture was heated to 65° C. The pH of the system was adjusted to 7.0 by appropriate addition of sodium hydroxide. The state was held for 3 hours to fuse the aggregated particles. The mixture was cooled to 25° C. The solid concentration in the dispersion was adjusted to 20% by mass by the addition of ion-exchanged water, thereby providing a toner slurry.

To 500.0 parts of the resulting toner slurry (solid content: 100.0 parts), 25.0 parts of dispersion S3 of fine particles for a shell (solid content: 5.0 parts) produced in Synthesis Example 18 was slowly added under stirring. The temperature of a heating oil bath was increased. Stirring was continued for 2 hours with the temperature maintained at 70° C. to perform treatment for allowing the shell resin to adhere to surfaces of particles contained in the toner slurry, thereby providing toner slurry 4.

Production Example 25 of Toner Slurry

Toner slurry 25 was produced as in Production Example 4 of toner slurry, except that crystalline resin 5 was used in place of crystalline resin 6, amorphous resin 3 was used in place of amorphous resin 4, the amount of the crystalline resin dispersion fed was changed from 120.0 parts to 150.0 parts, the amount of the amorphous resin dispersion fed was changed from 120.0 parts to 150.0 parts, and the crystalline resin dispersion added after the aggregation step was not used.

Production Example 27 of Toner Slurry

Toner slurry 27 was produced as in Production Example 4 of toner slurry, except that crystalline resin 5 was used in place of crystalline resin 7, the amount of the crystalline resin dispersion fed was changed from 120.0 parts to 300.0 parts, the amorphous resin dispersion was not used, and the crystalline resin dispersion added after the aggregation step was not used.

Production Example 18 of Toner Slurry

| | |
|---|---|
| releaseagent: paraffin wax (HNP-51, manufactured by Nippon Seiro Co., Ltd., melting point: 74° C.) | 10.0 parts |
| pigment blue 15:3 (manufactured by Dainichiseika Color & Chemicals Mfg. Co., Ltd.) | 5.0 parts |
| crystalline resin 6 | 40.0 parts |
| amorphous resin 4 | 40.0 parts |
| toluene (SP value: 8.8) | 150.0 parts |

The foregoing solution was charged into a container. The solution was stirred and dispersed with Homodisper (manufactured by Tokushu Kika Kogyo Co. Ltd.) at 2000 rpm for 5 minutes to prepare an oil phase.

In another container, 390.0 parts of a 0.1 mol/L aqueous solution of sodium phosphate ($Na_3PO_4$) was added to 1152.0 parts of ion-exchanged water. The mixture was heated to 70° C. under stirring with CLEAMIX (manufactured by M Technique Co., Ltd). Thereafter, 58.0 parts of a 1.0 mol/L aqueous solution of calcium chloride ($CaCl_2$) was added thereto. Stirring was further continued to form a dispersion stabilizer composed of tricalcium phosphate ($Ca_3(PO_4)_2$), thereby preparing an aqueous medium.

Next, the oil phase was added to the aqueous phase. Granulation was performed by stirring the mixture at 10,000 rpm for 10 minutes at 60° C. in a nitrogen atmosphere with CLEAMIX (manufactured by M Technique Co., Ltd). Solvent removal was performed at 80° C. and a reduced pressure of 400 mbar over a period of 5 hours while the resulting suspension was stirred with a paddle impeller at a rotation speed of 150 rpm. The suspension was then cooled to 25° C. The solid concentration in the dispersion was adjusted to 20% by mass by the addition of ion-exchanged water, thereby providing a toner slurry.

To 500.0 parts of the resulting toner slurry (solid content: 100.0 parts), 25.0 parts of dispersion S3 of fine resin particles for a shell (solid content: 5.0 parts) produced in Synthesis Example 18 was slowly added under stirring. The temperature of a heating oil bath was increased. Stirring was continued for 2 hours with the temperature maintained at 70° C. to perform treatment for allowing the shell resin to adhere to surfaces of particles contained in the toner slurry, thereby providing toner slurry 18.

TABLE 6

| Toner slurry | Crystalline resin or monomer for forming crystalline resin | Amorphous resin or monomer for forming amorphous resin | Shell resin | Solvent added | Polymerization initiator | Polymerization temperature |
|---|---|---|---|---|---|---|
| 1 | crystalline resin 1 84.0 parts | styrene 100.0 parts<br>n-butyl acrylate 25.0 parts | resin S1 10.0 parts | toluene 100.0 parts | t-butyl peroxypivalate 6.0 parts | 70° C. |
| 2 | crystalline resin 6 84.0 parts | styrene 100.0 parts<br>n-butyl acrylate 25.0 parts<br>methyl methacrylate 20.0 parts<br>acrylic acid 5.0 parts | resin S1 10.0 parts | toluene 100.0 parts | t-butyl peroxypivalate 6.0 parts | 70° C. |
| 3 | behenyl acrylate 125.0 parts | amorphous resin 4 85.0 parts | — | toluene 50.0 parts | t-butyl peroxypivalate 6.0 parts | 70° C. |

TABLE 6-continued

| Toner slurry | Crystalline resin or monomer for forming crystalline resin | Amorphous resin or monomer for forming amorphous resin | Shell resin | Solvent added | Polymerization initiator | Polymerization temperature |
|---|---|---|---|---|---|---|
| 4 | emulsification-aggregation method | | | | | |
| 5 | crystalline resin 2 125.0 parts | styrene 100.0 parts<br>n-butyl acrylate 25.0 parts | resin S1 10.0 parts | no | t-butyl peroxypivalate 6.0 parts | 70° C. |
| 6 | crystalline resin 3 125.0 parts | styrene 100.0 parts<br>n-butyl acrylate 25.0 parts | resin S1 10.0 parts | no | t-butyl peroxypivalate 6.0 parts | 70° C. |
| 7 | behenyl acrylate 125.0 parts | amorphous resin 1 54.0 parts | — | toluene 50.0 parts | t-butyl peroxypivalate 6.0 parts | 60° C. |
| 8 | crystalline resin 1 84.0 parts | styrene 100.0 parts<br>n-butyl acrylate 25.0 parts | resin S1 10.0 parts | toluene 100.0 parts | t-butyl peroxypivalate 6.0 parts | 80° C. |
| 9 | behenyl acrylate 125.0 parts | amorphous resin 2 84.0 parts | — | toluene 50.0 parts | V65 6.0 parts | 80° C. |
| 10 | crystalline resin 4 84.0 parts | styrene 100.0 parts<br>n-butyl acrylate 25.0 parts | resin S1 10.0 parts | no | t-butyl peroxypivalate 6.0 parts | 60° C. |
| 11 | crystalline resin 4 84.0 parts | styrene 100.0 parts<br>n-butyl acrylate 25.0 parts | resin S1 10.0 parts | no | V65 6.0 parts | 60° C. |
| 12 | crystalline resin 7 84.0 parts | styrene 100.0 parts<br>n-butyl acrylate 25.0 parts | resin S1 10.0 parts | toluene 100.0 parts | t-butyl peroxypivalate 6.0 parts | 70° C. |
| 13 | behenyl acrylate 125.0 parts | amorphous resin 5 84.0 parts | — | toluene 50.0 parts | V65 6.0 parts | 60° C. |
| 14 | behenyl acrylate 125.0 parts | amorphous resin 6 84.0 parts | — | toluene 50.0 parts | V65 6.0 parts | 60° C. |
| 15 | crystalline resin 1 84.0 parts | styrene 100.0 parts<br>n-butyl acrylate 25.0 parts | — | toluene 100.0 parts | t-butyl peroxypivalate 6.0 parts | 70° C. |
| 16 | crystalline resin 5 84.0 parts | styrene 100.0 parts<br>n-butyl acrylate 25.0 parts | resin S1 10.0 parts | toluene 100.0 parts | t-butyl peroxypivalate 6.0 parts | 70° C. |
| 17 | crystalline resin 1 84.0 parts | styrene 100.0 parts<br>n-butyl acrylate 25.0 parts | resin S2 10.0 parts | toluene 100.0 parts | t-butyl peroxypivalate 6.0 parts | 70° C. |
| 18 | dissolution-suspension method | | | | | |
| 19 | stearyl acrylate 125.0 parts | amorphous resin 1 54.0 parts | — | toluene 50.0 parts | V65 6.0 parts | 80° C. |
| 20 | tetratriacontyl methaacrylate 125.0 parts | amorphous resin 1 54.0 parts | — | toluene 50.0 parts | V65 6.0 parts | 80° C. |
| 21 | crystalline resin 8 84.0 parts | styrene 100.0 parts<br>n-butyl acrylate 25.0 parts<br>methyl methacrylate 20.0 parts<br>acrylic acid 5.0 parts | resin S1 10.0 parts | toluene 100.0 parts | t-butyl peroxypivalate 6.0 parts | 70° C. |
| 22 | crystalline resin 1 54.0 parts | styrene 100.0 parts<br>n-butyl acrylate 25.0 parts | resin S1 10.0 parts | toluene 100.0 parts | t-butyl peroxypivalate 6.0 parts | 70° C. |
| 23 | crystalline resin 3 84.0 parts | styrene 100.0 parts<br>n-butyl acrylate 25.0 parts | resin S1 10.0 parts | ethyl acetate 100.0 parts | t-butyl peroxypivalate 10.0 parts | 80° C. |
| 24 | crystalline resin 7 84.0 parts | styrene 100.0 parts<br>n-butyl acrylate 25.0 parts | resin S1 10.0 parts | ethyl acetate 100.0 parts | t-butyl peroxypivalate 10.0 parts | 80° C. |
| 25 | emulsification-aggregation method | | | | | |
| 26 | behenyl acrylate 125.0 parts | — | resin S1 10.0 parts | toluene 100.0 parts | t-butyl peroxypivalate 6.0 parts | 70° C. |
| 27 | emulsification-aggregation method | | | | | |
| 28 | crystalline resin 9 84.0 parts | styrene 100.0 parts<br>n-butyl acrylate 25.0 parts<br>methyl methacrylate 20.0 parts<br>acrylic acid 5.0 parts | resin S1 10.0 parts | toluene 100.0 parts | t-butyl peroxypivalate 6.0 parts | 70° C. |

Examples 1 to 22 and Comparative Examples 1 to 6

Next, 100.0 parts of toner particles 1 were weighed, and 1 part of fine silica particles whose primary particles had a number-average particle size of 40 nm were added thereto. Mixing was performed with a Henschel mixer (manufactured by Mitsui Miike Chemical Engineering Machinery Co., Ltd.) to give toner 1.

Similarly, toners 2 to 22 were produced in examples with toner slurries 2 to 22. Toners 23 to 28 were produced in comparative examples with toner slurries 23 to 28.

Part of each of the toners was sampled, and the physical properties of the crystalline resin, the amorphous resin, and the resin for a shell in each toner were measured by the foregoing methods. Table 7 describes the results.

TABLE 7

| | Crystalline resin | | | | Amorphous resin | | | | Shell | | |
|---|---|---|---|---|---|---|---|---|---|---|---|
| Toner | Mw (C) | SP (C) | AV (C) (mgKOH/g) | Tm (C) (° C.) | Mw (A) | SP (A) | AV (A) (mgKOH/g) | Tm (A) (° C.) | Method of formation | AV (A) (mgKOH/g) | Storage modulus G' at Tm (° C.) (Pa) |
| 1 | 22000 | 8.9 | 0.2 | 65 | 20000 | 9.8 | 0.0 | 65 | in situ | 12.0 | $3.3 \times 10^8$ |
| 2 | 11000 | 9.5 | 2.5 | 81 | 20000 | 9.9 | 19.0 | 70 | in situ | 12.0 | $2.2 \times 10^7$ |
| 3 | 90000 | 8.9 | 0.0 | 65 | 11000 | 10.3 | 1.2 | 59 | in situ | 12.0 | $3.3 \times 10^8$ |
| 4 | 11000 | 9.5 | 2.5 | 81 | 11000 | 10.3 | 1.2 | 59 | surface adhesion | 19.0 | $2.2 \times 10^7$ |
| 5 | 6600 | 8.9 | 0.0 | 61 | 20000 | 9.8 | 0.0 | 65 | in situ | 12.0 | $3.5 \times 10^8$ |
| 6 | 4500 | 8.9 | 0.1 | 58 | 20000 | 9.8 | 0.0 | 65 | in situ | 12.0 | $3.5 \times 10^8$ |
| 7 | 120000 | 8.9 | 0.2 | 65 | 10000 | 9.8 | 0.4 | 60 | surface adhesion | 19.0 | $3.4 \times 10^8$ |
| 8 | 22000 | 8.9 | 0.2 | 65 | 8000 | 9.8 | 0.0 | 62 | in situ | 12.0 | $3.3 \times 10^8$ |
| 9 | 50000 | 8.9 | 0.1 | 65 | 7600 | 9.8 | 0.2 | 60 | surface adhesion | 19.0 | $3.4 \times 10^8$ |
| 10 | 13000 | 8.9 | 0.0 | 65 | 47000 | 9.8 | 0.0 | 65 | in situ | 12.0 | $3.3 \times 10^8$ |
| 11 | 13000 | 8.9 | 0.0 | 65 | 52000 | 9.8 | 0.0 | 65 | in situ | 12.0 | $3.3 \times 10^8$ |
| 12 | 11000 | 9.5 | 2.5 | 81 | 20000 | 9.8 | 0.0 | 65 | in situ | 12.0 | $2.0 \times 10^7$ |
| 13 | 30000 | 8.9 | 0.3 | 65 | 18000 | 10.2 | 1.5 | 68 | surface adhesion | 19.0 | $3.4 \times 10^8$ |
| 14 | 40000 | 8.9 | 0.3 | 65 | 9600 | 10.5 | 10.8 | 63 | surface adhesion | 19.0 | $3.4 \times 10^8$ |
| 15 | 22000 | 8.9 | 0.2 | 65 | 19000 | 9.8 | 0.0 | 65 | — | — | — |
| 16 | 13200 | 9.0 | 22.3 | 66 | 20000 | 9.8 | 0.0 | 65 | in situ | 12.0 | $3.3 \times 10^8$ |
| 17 | 22000 | 8.9 | 0.2 | 65 | 20000 | 9.8 | 0.0 | 65 | in situ | 4.2 | $3.2 \times 10^8$ |
| 18 | 11000 | 9.5 | 2.5 | 81 | 11000 | 10.3 | 1.2 | 59 | surface adhesion | 19.0 | $2.2 \times 10^7$ |
| 19 | 50000 | 9.2 | 0.1 | 52 | 10000 | 9.8 | 0.4 | 60 | surface adhesion | 19.0 | $3.5 \times 10^8$ |
| 20 | 30000 | 8.8 | 0.2 | 80 | 10000 | 9.8 | 0.4 | 60 | surface adhesion | 19.0 | $2.3 \times 10^7$ |
| 21 | 11000 | 9.9 | 5.0 | 105 | 20000 | 9.9 | 19.0 | 70 | in situ | 12.0 | $8.4 \times 10^4$ |
| 22 | 22000 | 8.9 | 0.2 | 65 | 20000 | 9.8 | 0.0 | 65 | in situ | 12.0 | $3.3 \times 10^8$ |
| 23 | 4500 | 8.9 | 0.1 | 58 | 7000 | 9.8 | 0.0 | 60 | in situ | 12.0 | $3.5 \times 10^8$ |
| 24 | 7000 | 9.7 | 6.2 | 70 | 7000 | 9.8 | 0.0 | 60 | in situ | 12.0 | $1.5 \times 10^8$ |
| 25 | 5000 | 8.9 | 0.2 | 60 | 5800 | 10.1 | 29.0 | 55 | surface adhesion | 19.0 | $3.4 \times 10^8$ |
| 26 | 50000 | 8.9 | 0.1 | 65 | — | — | — | — | in situ | 12.0 | $3.3 \times 10^8$ |
| 27 | 11000 | 9.5 | 2.5 | 81 | — | — | — | — | surface adhesion | 19.0 | $2.2 \times 10^7$ |
| 28 | 11000 | 9.5 | 3.8 | 110 | 20000 | 9.9 | 19.0 | 70 | in situ | 12.0 | $5.0 \times 10^3$ |

The phase-separated structures of toners 1 to 28 were observed according to the foregoing methods. For toners 3, 7, 9, 13, 14, 19, 20, and 26 in which the crystalline resins were produced by suspension polymerization, the composition analysis of the crystalline resins was performed by measuring $^1$H-NMR spectra as described above. The results demonstrated that crystalline resins formed by the polymerization of the monomers used were contained. Table 8 describes the results.

TABLE 8

| | Sea portion | Island portion | Average circle-equivalent diameter of island portion (nm) | Presence of shell |
|---|---|---|---|---|
| Toner 1 | crystalline resin | amorphous resin | 80 | yes |
| Toner 2 | crystalline resin | amorphous resin | 50 | yes |
| Toner 3 | crystalline resin | amorphous resin | 150 | yes |
| Toner 4 | crystalline resin | amorphous resin | 180 | yes |
| Toner 5 | crystalline resin | amorphous resin | 180 | yes |
| Toner 6 | crystalline resin | amorphous resin | 200 | yes |
| Toner 7 | crystalline resin | amorphous resin | 200 | yes |
| Toner 8 | crystalline resin | amorphous resin | 300 | yes |
| Toner 9 | crystalline resin | amorphous resin | 350 | yes |

TABLE 8-continued

| | Sea portion | Island portion | Average circle-equivalent diameter of island portion (nm) | Presence of shell |
|---|---|---|---|---|
| Toner 10 | crystalline resin | amorphous resin | 80 | yes |
| Toner 11 | crystalline resin | amorphous resin | 80 | yes |

TABLE 8-continued

| | Sea portion | Island portion | Average circle-equivalent diameter of island portion (nm) | Presence of shell |
|---|---|---|---|---|
| Toner 12 | crystalline resin | amorphous resin | 40 | yes |
| Toner 13 | crystalline resin | amorphous resin | 300 | yes |
| Toner 14 | crystalline resin | amorphous resin | 300 | yes |
| Toner 15 | crystalline resin | amorphous resin | 200 | no |
| Toner 16 | crystalline resin | amorphous resin | 100 | yes |
| Toner 17 | crystalline resin | amorphous resin | 80 | yes |
| Toner 18 | crystalline resin | amorphous resin | 30 | yes |
| Toner 19 | crystalline resin | amorphous resin | 200 | yes |
| Toner 20 | crystalline resin | amorphous resin | 60 | yes |
| Toner 21 | crystalline resin | amorphous resin | 40 | yes |
| Toner 22 | crystalline resin | amorphous resin | 40 | yes |
| Toner 23 | amorphous resin | crystalline resin | 300 | yes |
| Toner 24 | amorphous resin | crystalline resin | 900 | yes |
| Toner 25 | amorphous resin | crystalline resin | 200 | yes |
| Toner 26 | crystalline resin | — | — | yes |
| Toner 27 | crystalline resin | — | — | yes |
| Toner 28 | crystalline resin | amorphous resin | 30 | yes |

Image Formation Test

Evaluation tests described below were performed with toners 1 to 28. Table 9 describes the evaluation results.

Fixability

A color laser printer in which a fixing unit was detached (HP Color LaserJet 3525dn, manufactured by Hewlett-Packard Company) was prepared. A toner in a cyan cartridge was removed. Each of the toners to be evaluated was charged thereinto instead. Unfixed toner images (0.6 mg/cm$^2$) each having a length of 2.0 cm and a width of 15.0 cm were each formed on a portion 1.0 cm distant from an upper end of image-receiving paper (Office Planner, manufactured by CANON KABUSHIKI KAISHA, 64 g/m$^2$) in the running direction with the charged toner. The detached fixing unit was modified in such a manner that the fixing temperature and the process speed can be controlled. A fixing test of the unfixed images was performed with this unit.

Low-Temperature Fixability

The unfixed images were fixed at different temperatures in a normal-temperature and normal-humidity environment (23° C., 60% RH) at a process speed of 160 mm/s, a fixing linear pressure of 10.0 kgf, provided that the initial temperature was 80° C. and that the preset temperature was increased in 5° C. increments.

Evaluation criteria for low-temperature fixability are described below. A low-temperature-side fixing initiation point indicates a lower limit temperature at which a low-temperature offset phenomenon (a phenomenon in which part of toner sticks to a fixing device) is not observed.

A: The low-temperature-side fixing initiation point is 85° C. or lower.

B: The low-temperature-side fixing initiation point is 90° C. or 95° C.

C: The low-temperature-side fixing initiation point is 100° C. or 105° C.

D: The low-temperature-side fixing initiation point is 110° C. or 115° C.

E: The low-temperature-side fixing initiation point is 120° C. or higher.

Strength of Fixed Image

A fixed image (0.6 mg/cm$^2$) was formed at a preset temperature 10° C. higher than the low-temperature-side fixing initiation point. The middle portion of the resulting fixed image was folded in the longitudinal direction so as to be located on the front surface, and was creased at a load of 4.9 kPa (50 g/cm$^2$). A crease perpendicular to the crease was similarly formed. The intersection point of the creases was rubbed with Silbon paper (Dusper K-3) five times under a load of 4.9 kPa (50 g/cm$^2$) at a speed of 0.2 m/sec. The rate of reduction in density due to the rubbing was measured.

From the results, the strength of the image was evaluated according to criteria described below.

A: The rate of reduction in image density is less than 5.0%.

B: The rate of reduction in image density is 5.0% or more and less than 10.0%.

C: The rate of reduction in image density is 10.0% or more and less than 15.0%.

D: The rate of reduction in image density is 15.0% or more and less than 20.0%.

E: The rate of reduction in image density is 20.0% or more.

Gloss of Fixed Image

The gloss of an image fixed at a preset temperature 10° C. higher than the low-temperature-side fixing initiation point was measured with a handy gloss meter PG-3D (manufactured by Nippon Denshoku Industries Co., Ltd.) at an angle of light incidence of 75° and evaluated according to criteria described below.

A: The gloss of an image portion is 20 or more.

B: The gloss of an image portion is 15 or more and less than 20.

C: The gloss of an image portion is 10 or more and less than 15.

D: The gloss of an image portion is 5 or more and less than 10.

E: The gloss of an image portion is less than 5.

The setting of the fixing unit was changed as follows: the process speed was set to 160 mm/s, and the fixing linear pressure was set to 28.0 kgf. The unfixed images were fixed at different temperatures in a normal-temperature and normal-humidity environment, provided that the initial temperature was 80° C. and that the preset temperature was increased in 5° C. increments. The high-temperature offset resistance was evaluated according to criteria described below.

A: The upper limit temperature at which the high-temperature offset does not occur is at least 50° C. higher than the low-temperature-side fixing initiation point.

B: The upper limit temperature at which the high-temperature offset does not occur is 40° C. or 45° C. higher than the low-temperature-side fixing initiation point.

C: The upper limit temperature at which the high-temperature offset does not occur is 30° C. or 35° C. higher than the low-temperature-side fixing initiation point.

D: The upper limit temperature at which the high-temperature offset does not occur is 20° C. or 25° C. higher than the low-temperature-side fixing initiation point.

E: The upper limit temperature at which the high-temperature offset does not occur is at most 15° C. higher than the low-temperature-side fixing initiation point.

Durability

A commercially available color laser printer (HP Color LaserJet 3525dn, manufactured by Hewlett-Packard Company) was modified so as to be operable even if a single-color process cartridge was attached, and evaluations were performed. A toner in a cyan cartridge attached to this color laser printer was removed. After the inside was cleaned by blowing air, the toner (300 g) to be evaluated was charged thereinto instead. Office Planner manufactured by CANON KABUSHIKI KAISHA (64 g/m$^2$) was used as image-receiving paper, and 2000 sheets of a chart with a coverage of 2% were continuously output in a normal-temperature and normal-humidity environment.

Observation of Fusion on Developing Roller and Streak on Image

After the output, a halftone image was output. A developing roller and the halftone image were visually observed to check the presence or absence of fusion and a streak on the image due to cracking or crashing of the toner.

A: No longitudinal streak that seems to be a developer streak is observed on the developing roller or the image of the halftone portion in the delivery direction.

B: Although one to five narrow streaks are observed on both ends of the developing roller in the circumferential direction, no longitudinal streak that seems to be a developer streak is observed on the image of the halftone portion in the delivery direction.

C: One to five narrow streaks are observed on both ends of the developing roller in the circumferential direction, and several narrow developer streaks are also observed on the image of the halftone portion.

D: Six or more narrow streaks are observed on both ends of the developing roller in the circumferential direction, and narrow developer streaks are also observed on the image of the halftone portion.

E: Many noticeable developer streaks are observed on the developing roller and the image of the halftone portion.

Fog

After the output of 2000 sheets, a white image was output in the same environment, and the reflectance was measured with TC-6DS (manufactured by Tokyo Denshoku Co., Ltd). Separately, the reflectance of unused paper was measured. The fog density was defined by subtracting the reflectance of the unused paper from the reflectance of the white image. A lower fog density indicates that the toner has better chargeability.

A: The chargeability is particularly excellent (a fog density of less than 1.0%).

B: The chargeability is excellent (a fog density of 1.0% or more and less than 2.0%).

C: The chargeability is good (a fog density of 2.0 or more and less than 3.0%).

D: The chargeability is slightly poor (a fog density of 3.0 or more and less than 4.0%).

E: The chargeability is poor (a fog density of 4.0% or more).

After the foregoing evaluation, the cartridge was allowed to stand in a high-temperature and high-humidity environment (40° C., 95% RH) for 3 days. Thereafter, the cartridge was allowed to stand in a normal-temperature and normal-humidity environment (23° C., 60% RH) for one day. Then a white image was output. The foregoing fog density was measured to evaluate the charging characteristics after exposure to the high-temperature and high-humidity environment. The same evaluation criteria as those described above were used.

TABLE 9

| | | | | | Durability | | |
|---|---|---|---|---|---|---|---|
| | Low temperature fixability | Strength of image | Gloss of image | High-temperature offset resistance | Observation of developing roller and image | Fog after 2000 sheets | Fog after exposure to high temperature and high humidity |
| Example 1 | A (80° C.) | A (2.9%) | B (18) | A (140° C.) | A | A (0.5%) | A (0.8%) |
| Example 2 | B (95° C.) | A (2.1%) | A (20) | C (140° C.) | B | C (2.1%) | C (2.4%) |
| Example 3 | A (80° C.) | A (4.2%) | B (16) | A (140° C.) | A | A (0.3%) | A (0.7%) |
| Example 4 | C (100° C.) | A (1.5%) | C (14) | C (135° C.) | C | B (1.2%) | B (1.9%) |
| Example 5 | A (80° C.) | A (4.9%) | A (22) | B (120° C.) | B | B (1.2%) | B (1.6%) |
| Example 6 | A (80° C.) | B (5.8%) | A (21) | C (110° C.) | C | B (1.1%) | C (2.3%) |
| Example 7 | B (90° C.) | C (10.2%) | C (12) | A (150° C.) | A | A (0.2%) | A (0.4%) |
| Example 8 | C (100° C.) | B (9.2%) | B (19) | B (140° C.) | C | B (1.0%) | B (1.7%) |
| Example 9 | C (100° C.) | B (8.9%) | B (18) | B (140° C.) | C | B (1.6%) | B (1.9%) |
| Example 10 | B (90° C.) | C (11.2%) | C (13) | A (150° C.) | A | A (0.4%) | A (0.5%) |
| Example 11 | C (100° C.) | C (14.5%) | C (12) | A (150° C.) | A | A (0.4%) | A (0.6%) |
| Example 12 | C (100° C.) | A (1.8%) | A (21) | C (130° C.) | C | C (2.7%) | C (2.7%) |
| Example 13 | A (80° C.) | C (12.0%) | B (15) | A (130° C.) | B | A (0.2%) | A (0.4%) |
| Example 14 | C (105° C.) | C (14.5%) | C (14) | B (150° C.) | B | A (0.2%) | A (0.6%) |
| Example 15 | A (80° C.) | B (5.8%) | C (14) | C (115° C.) | C | C (2.2%) | C (2.9%) |
| Example 16 | A (80° C.) | A (4.1%) | B (17) | A (140° C.) | C | C (2.4%) | C (2.8%) |
| Example 17 | A (80° C.) | A (2.5%) | B (17) | A (140° C.) | B | C (2.1%) | C (2.9%) |
| Example 18 | C (100° C.) | A (1.2%) | C (14) | C (130° C.) | C | C (2.1%) | C (2.9%) |
| Example 19 | A (80° C.) | B (5.9%) | B (18) | C (115° C.) | C | B (1.2%) | C (2.9%) |
| Example 20 | C (100° C.) | A (2.0%) | A (20) | C (140° C.) | B | B (1.1%) | C (2.7%) |
| Example 21 | C (105° C.) | A (4.5%) | B (16) | C (140° C.) | B | C (2.2%) | C (2.3%) |
| Example 22 | C (105° C.) | A (1.2%) | C (12) | B (140° C.) | A | A (0.5%) | A (0.6%) |
| Comparative Example 1 | E (140° C.) | B (5.8%) | D (7) | D (160° C.) | E | A (0.3%) | A (0.9%) |
| Comparative Example 2 | E (130° C.) | A (4.2%) | D (9) | E (140° C.) | D | A (0.3%) | D (3.9%) |
| Comparative Example 3 | E (130° C.) | B (5.9%) | C (12) | E (140° C.) | E | A (0.2%) | E (4.1%) |
| Comparative Example 4 | A (80° C.) | E (20.2%) | D (8) | E (90° C.) | E | C (2.7%) | C (2.9%) |
| Comparative Example 5 | C (100° C.) | D (18.9%) | E (4) | E (100° C.) | E | C (2.4%) | D (3.7%) |
| Comparative Example 6 | E (140° C.) | A (4.6%) | B (15) | D (160° C.) | B | C (2.2%) | C (2.4%) |

According to the present invention, a toner capable of being fixed at low energy and providing an image with high resistance to external forces, such as rubbing and scratching, is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

A toner of the present invention can be used as a toner to develop an electrostatic latent image formed by a method, for example, an electrophotographic method, an electrostatic recording method, or a toner jet recording method.

The invention claimed is:

1. A toner comprising toner particles containing a binder resin and a colorant, wherein each of the toner particles has a core-shell structure, the binder resin contains an amorphous resin A and a crystalline resin C, the amorphous resin A has a glass transition temperature Tg (A) of 40° C. or higher and 80° C. or lower, the crystalline resin C (i) has a melting point Tm (C) of 50° C. or higher and 110° C. or lower, (ii) is a side-chain crystalline resin, (iii) is a vinyl-based resin containing a moiety represented by the general formula 1 in an amount of 50% by mass or more, general formula 1

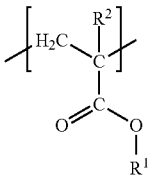

where $R^1$ represents an alkyl group having 16 to 34 carbon atoms, and $R^2$ represents hydrogen or a methyl group, and (iv) has an acid value AV(C) of 0.0 mg KOH/g or more and 0.3 mgKOH/g or less, in a cross section observation of each of the toner particles, a sea-island structure including a sea portion composed of the crystalline resin C serving as a main component and island portions composed of the amorphous resin A serving as a main component, is observed in a core of the core-shell structure, a resin S constituting a shell of the core-shell structure has a storage modulus G' of $1\times10^4$ Pa to $1\times10^{10}$ Pa at the melting point Tm (C), and when an acid value of the resin S is represented by AV(S), AV(C) and AV(S) satisfy following expression:

$$5.0\ \text{mgKOH/g} \leq AV(S)-AV(C).$$

2. The toner according to claim 1, wherein the crystalline resin C has a weight-average molecular weight Mw (C) of 5,000 or more and 100,000 or less, and the amorphous resin A has a weight-average molecular weight Mw (A) of 8,000 or more and 50,000 or less.

3. The toner according to claim 1, wherein when the SP value of the crystalline resin C is represented by SP (C), and the SP value of the amorphous resin A is represented by SP (A), a difference ΔSP (CA) between SP (C) and SP (A) is 0.3 or more and 1.5 or less.

4. The toner according to claim 1, wherein the binder resin has a crystalline resin C content of 30% by mass or more and 70% by mass or less with respect to the mass of the binder resin.

5. The toner according to claim 1, wherein the resin S constituting a shell of the core-shell structure has an acid value AV (S) of 10.0 mgKOH/g or more and 40.0 mgKOH/g or less.

6. The toner according to claim 1, wherein when the acid value of the amorphous resin A is represented by AV (A), and the acid value of the crystalline resin C is represented by AV (C), a difference between AV (A) and AV (C) (AV (C)−AV (A)) is 0 mgKOH/g or more and 10.0 mgKOH/g or less.

7. The toner according to claim 1, wherein the melting point Tm (C) of the crystalline resin C and the glass transition temperature Tg (A) of the amorphous resin A satisfy the following expression:

$$0°\ \text{C.} \leq Tm(C)-Tg(A) \leq 30°\ \text{C.}$$

8. The toner according to claim 1, wherein the toner particles are toner particles formed by dispersing a monomer composition containing a polymerizable monomer and a colorant in an aqueous medium, performing granulation, and polymerizing the polymerizable monomer in droplet particles formed by the granulation.

9. The toner according to claim 1, wherein the island portions have a number-average circle-equivalent diameter of from 30 to 500 nm.

* * * * *